US011045853B2

(12) United States Patent
Vilaca

(10) Patent No.: US 11,045,853 B2
(45) Date of Patent: Jun. 29, 2021

(54) METHOD AND TOOLS FOR MANUFACTURING OF SEAMLESS TUBULAR SHAPES, ESPECIALLY TUBES

(71) Applicant: Aalto University Foundation sr, Helsinki (FI)

(72) Inventor: Pedro Vilaca, Espoo (FI)

(73) Assignee: Aalto University Foundation sr, Helsinki (FI)

( * ) Notice: Subject to any disclaimer, the term of this patent is extended or adjusted under 35 U.S.C. 154(b) by 217 days.

(21) Appl. No.: 16/079,024

(22) PCT Filed: Feb. 20, 2017

(86) PCT No.: PCT/FI2017/050109
§ 371 (c)(1),
(2) Date: Aug. 22, 2018

(87) PCT Pub. No.: WO2017/144775
PCT Pub. Date: Aug. 31, 2017

(65) Prior Publication Data

US 2019/0060969 A1 Feb. 28, 2019

(30) Foreign Application Priority Data

Feb. 22, 2016 (FI) ..... 20160043
Feb. 8, 2017 (FI) ..... 20170018

(51) Int. Cl.
*B21C 37/06* (2006.01)
*B21J 5/06* (2006.01)
*B21J 5/08* (2006.01)

(52) U.S. Cl.
CPC ..... *B21C 37/06* (2013.01); *B21J 5/063* (2013.01); *B21J 5/08* (2013.01)

(58) Field of Classification Search
CPC ..... B21C 23/18; B21C 23/183; B21C 23/186; B21C 37/06; B21J 5/022; B21J 5/08; B21J 5/063; B21J 5/066; C21D 7/04
(Continued)

(56) References Cited

U.S. PATENT DOCUMENTS 2,759,258 A * 8/1956 Rochester ..... B21J 5/10 72/70
3,029,507 A 4/1962 Gaggini
(Continued)

FOREIGN PATENT DOCUMENTS

DE 3626009 A1 2/1987
DE 29924160 U1 5/2002
(Continued)

OTHER PUBLICATIONS

Good Career, Backward Extrusion , https://www.youtube.com/watch?v=iGIXpDUxNcA (Year: 2016).*
(Continued)

*Primary Examiner* — Adam J Eiseman
*Assistant Examiner* — Bobby Yeonjin Kim
(74) *Attorney, Agent, or Firm* — Chernoff, Vilhauer, McClung & Stenzel, LLP

(57) ABSTRACT

The present invention relates to a method and tools for manufacturing of seamless tubular shapes, especially tubes and canisters. In the method of the invention the tubular shape is extracted from the flash continuously produced during the plunging of a consumable rod against a rigid anvil. The tools of the invention include a consumable rod; a non-consumable or consumable rigid anvil; first means for rotating the consumable rod and the non-consumable or consumable rigid anvil relatively with respect of each other; second means for plunging the consumable rod and the non-consumable or consumable rigid anvil relatively against
(Continued)

Figure 1:
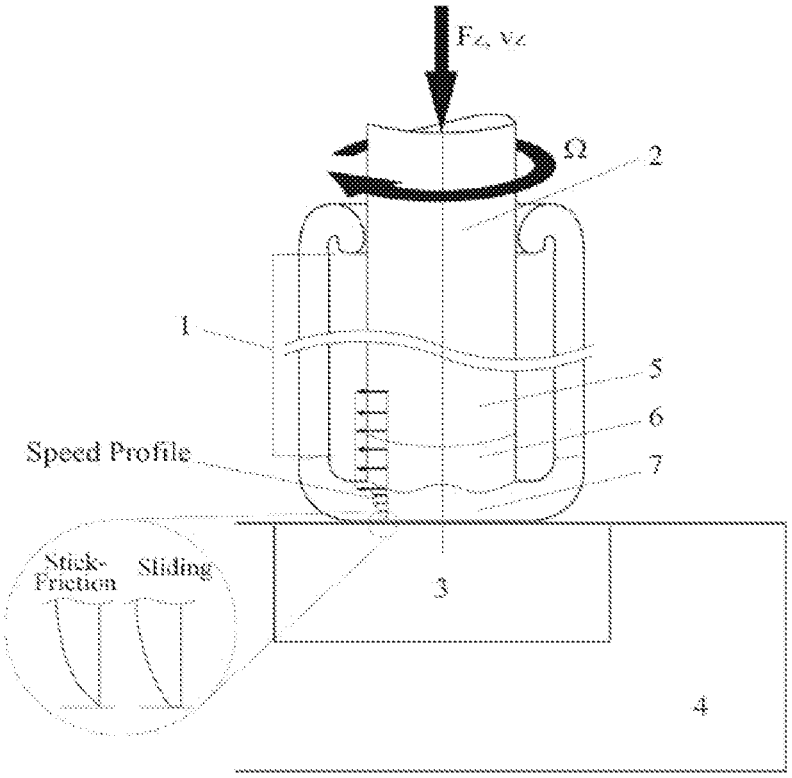
Figure 1:
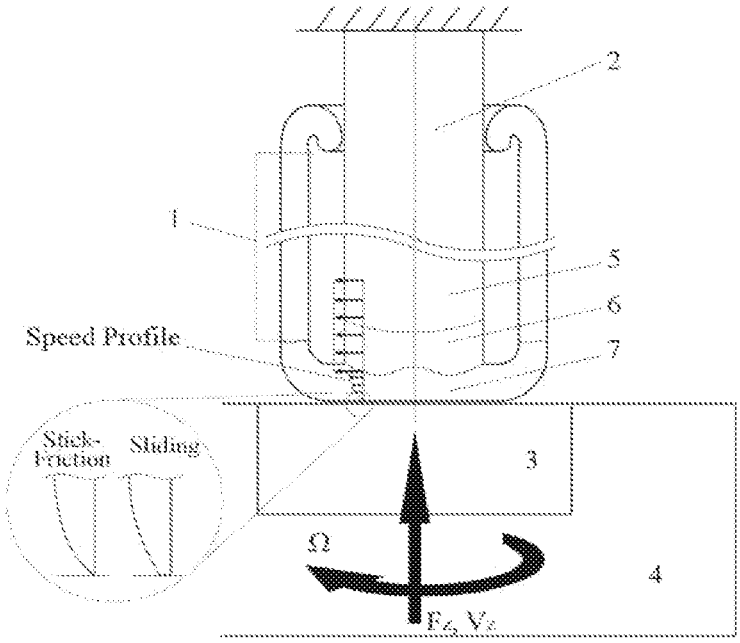

each other; open die condition configuration for continuous production of flash during said plunging.

13 Claims, 6 Drawing Sheets

(58) Field of Classification Search
USPC ..... 228/112.1–114.5, 2.1–2.3
See application file for complete search history.

(56) References Cited

U.S. PATENT DOCUMENTS

| | | | | |
|---|---|---|---|---|
| 3,201,966 | A | 8/1965 | Benteler et al. | |
| 5,262,123 | A * | 11/1993 | Thomas | B21C 23/22 419/41 |

FOREIGN PATENT DOCUMENTS

| | | | | |
|---|---|---|---|---|
| EP | 0267562 | A2 | 5/1988 | |
| EP | 0460900 | * | 6/1991 | B21C 23/00 |
| EP | 0601932 | A1 | 6/1994 | |
| EP | 0460900 | B1 | 4/1997 | |
| EP | 1193720 | A1 | 4/2002 | |
| EP | 2796219 | A1 | 10/2014 | |
| WO | 2006016417 | A1 | 2/2006 | |

OTHER PUBLICATIONS

Finnish Patent and Registration Office; Search Report issued in application FI 20160043; dated Sep. 15, 2016; 2 pages; Finnish Patent and Registration Office; Helsinki, Finland.

Charvet, Pierre; International Search Report issued in application No. PCT/FI2017/050109; dated May 29, 2017; 4 pages; European Patent Office; Rijswijk, Netherlands.

Charvet, Pierre; Written Opinion of the International Searching Authority issued in application No. PCT/FI2017/050109; dated May 29, 2017; 6 pages; European Patent Office; Rijswijk, Netherlands.

Charvet, Pierre; International Preliminary Report on Patentability issued in application No. PCT/FI2017/050109; dated Jun. 5, 2018; 27 pages; European Patent Office; Rijswijk, Netherlands.

Lu Suling, et al.; Reverse Prediction Studies of Billets Set on Open-die Cold Extrusion of Thick Wall Pipe; Journal of Mechanical Engineering; vol. 50, No. 10; May 2014; pp. 98-102.

Andrews / Gilpin; Friction forging—a preliminary study; The Metallurgist and Materials Technologist; Jul. 1975; pp. 355-358.

* cited by examiner (a)

(b)

(a) (b) (c) (d)

METHOD AND TOOLS FOR MANUFACTURING OF SEAMLESS TUBULAR SHAPES, ESPECIALLY TUBES

CROSS-REFERENCE TO RELATED APPLICATIONS

This application is a U.S. national stage application of PCT/FI2017/050109, filed on Feb. 20, 2017 and claims priority of Finnish Patent Application No. 20160043 filed Feb. 22, 2016, and Finnish Patent Application No. 20170018 filed Feb. 8, 2017.

OBJECT OF THE INVENTION

One object of the invention is a method for manufacturing of seamless tubular shapes, especially tubes or canisters, from flash of continuous plunge rotary friction in open die condition as defined in the preamble of the independent claim 1.

Another object of the invention concerns tools for manufacturing of seamless tubular shapes, especially tubes and canisters, from flash resulting from continuous plunge rotary friction as defined in the preamble of the independent claim 10.

PRIOR ART

In the manufacturing industry there are several different methods and processes for manufacturing of tubular components in several shapes, especially welded tubes and seamless tubes. One typical method is to press an ingot against a mandrel with a certain diameter to obtain a tube with the diameter of the mandrel as Its inner diameter and further to press the tube through rolling equipment to obtain me needed outer diameter of the tube. These two steps to obtain needed inner and outer diameter may be performed at the same time.

The most relevant state-of-the-art is disclosed in the European patent EP 0601932 B1 where the document relates to the possibility of producing seamless hollow shells of a variable thickness with same diameter using a single mandrel bar, as an improvement of the Mannesmann process. The solution disclosed in EP 0601932 B1 provides flexibility to produce tubes with different wall thickness without changing tooling. This poor art solution however needs an external heat source and it still has most of all the other drawbacks of the original Mannesmann process, namely complex system of components undergoing high wear.

Another state-of-the-art technology has been specified in the European patent application EP 1193720 A1. The solution disclosed in EP 1193720 A1 relates to the geometry of a billet before forming. This solution requires a pre-heated billet and tooling, and has fully closed die condition, which explicitly determines the product geometry. This document relates to the manufacture of thick walled containers formed integrally (seamlessly), or a thick cylinder, or a canister, from an externally heated billet by forward and backward extrusion. In the EP 1193720 A1 there is a need for an external heat source, high wear of components, a big limitation of applicable materials, and the method is applicable only to produce thick wall canisters and it demands multiple plunging sequences to reduce the thickness.

The EP 0460900 B1 discloses the production of tubes as one possible application of the invention disclosed therein. However, the disclosed method for manufacturing of tubular shapes must have an inside mandrel (for shaping and forming the inner contour of a tube) and a fully closed outer die. Further, three webs that are necessary for supporting the central member (the mandrel) in this prior art method make the material flow divide into three separate flow paths, that later "coalesce to form a seamless tube". The method of the invention does not divide the material flow into separate paths. With this prior art method each tooling only produces one specific tube geometry. This prior art method thus also has the drawback of being a complex system of several components since each geometry requires its own specific tools.

A friction forging process is described in "D. R. Andrews, M. J. Gilpin (1975) Friction Forging—A preliminary Study. The Metallurgist and Materials Technologist. Volume July, pp. 355-358". This article depicts the capacity of using the viscoplasticity at the tip of a rotative rod to produce "flanges at the tip of a shaft" (in closed-die condition) and "ears at the tip of a shaft" (in open-die condition), but the production of continuous flash is not disclosed, and the production of tubular shapes, is not addressed at all.

DESCRIPTION OF THE INVENTION

With the purpose of solving at least some of the disadvantages of the prior art, the method of the invention is characterised by the features defined in the characterizing part of the independent claim 1.

Preferred embodiments of the method of the invention are described in the appended dependent claims.

The tools according to the invention are characterised by the features defined in the characterizing part of the independent claim 10. The tools include:

- a consumable rod
- a non-consumable or consumable rigid anvil
- first means for rotating the consumable rod and the non-consumable or consumable rigid anvil relatively with respect of each other
- second means for plunging the consumable rod and the non-consumable or consumable rigid anvil relatively against each other
- open die condition configuration for continuous production of flash during said plunging.

Preferred embodiments of the tools of the invention are described in the appended dependent claims.

Along this text, the word "tubes" stands for both "tubes and pipes" in finished form, i.e. not in the form of a flash. Also along this text, a canister is a tube or pipe having a closed bottom in one end thereof. In this text the term "tubular shape" refers to any kind of cavity defined by a sleeve having a thickness, an inner diameter and outer diameter, each of which may independently be constant or varied along the length of the tubular shape.

The method of the invention produces tubular shapes out of continuous flash obtained by viscoplastic deformation against a non-consumable plate unit, in full open die condition, i.e. with no extrusion, or rolling phenomena involved. The method of the invention is not based on inverse extrusion, but on open die viscoplastic material flow, where the cold part of the consumable rod, acts as a plunger itself. The method of the invention has the advantage over the prior art that it is able to produce a wide range of different tube configurations, namely continuous variable diameters and wall thicknesses with the same tooling, just by controlling the process parameters.

It is known from the long-time established extrusion technology of, for example aluminum alloys (without rotation), that webs supporting extrusion die central members leave a transition zone to the product, and that this transition zone can be distinguished from those parts of the profile that have not been divided into separate flow paths to go past the supporting webs. It should therefore be noted, that one of the key characteristics of the method of the invention is the ability to produce seamless hollow profiles from solid consumables (without pre-perforation etc.) without using tools or dies to flow and extrude the material in what later turns out to be the inner surface of the tubular product. The present invention may involve using guides (ring guides) with the single purpose to drive the consumable rod with precision and provide stability to prevent buckling of the rod.

However, as the method of the invention does not substantially have closed dies around the working zone, the control of the process parameters e.g. force during the stationary period and plunging speed during the initial transient plunging period, have a fundamental importance for the method to produce good quality tubes. In other words, the said parameters and control methods have importance of different proportions because the tube geometry is strongly affected by them, whereas the tube geometry produced by prior art methods involving closed dies around the working zone is less dependent of the said parameters and control method.

The products of the method of the invention (tubular shape) are obtained directly from the flash, extracting both ends (the open and the close end) to obtain the tube, or only the open end, to obtain the canister.

In the method of the invention only a small fraction of the workpiece is deformed at once, allowing heat of deformation to build up and soften the material so that even high-strength materials can be worked, for which an instantaneous impact forming method is not suitable.

The present invention provides a method and tools for production of seamless tubes without working the tube inner part and surface with any kind of tool. Further, the method of the present invention does not necessarily need any working from the tube outer surface. In the simplest embodiment, the only tool is a non-consumable flat surface made of any material that can withstand the mechanical and thermal loadings exerted by the consumable. In other words, in the simplest embodiment, the method of the invention can produce seamless tubes without having any radial action exerted from either the inside or the outside to the consumable or the resulting tube.

As mentioned earlier, the initial shape of the consumable rod, and the process parameters (force, plunging speed and rotation) have direct effect on the resulting tube geometry. Although control of those parameters is common in the industrial context, the direct effect that they have on the invention's outcome is not obvious, and mastering that effect has in fact turned out to be one major scientific challenge. For example, in most industrial processes, the typical effect of such parameters is limited to the performance of the production process, e.g. productivity increases with increasing speed. However, for the method of the invention, because the method operates in open die condition, the parameters only work within the processing window of equilibrium, and have an effect of existential nature on the outcome. The present method has a processing window, derived from material properties and laws of physics. Also, the present method's parameters are interdependent, and therefore cannot be set independently without the risk of going outside of the processing window.

The present invention has the following benefits over the prior art solutions:

- it does not need an external heat source or any pre-heating of the components
- it provides the ability to process a greater variety of materials and a production system that is less expensive and complex
- it provides no minimum economical production amount
- it causes no need for stock/storage
- it creates no relevant wear on any of the few components in the production system e.g. long life of rigid non-consumable anvil that is the component undergoing higher wear)
- it does not need any closed dies around the material under work, whereby the product geometry is not determined by the tooling
- it requires less troublesome steps for the manufacture and has an excellent end surface
- it enables production of a wide range of different tube and canister configurations, namely continuous variable diameters and wall thicknesses with the same tooling just by controlling the parameters

DETAILED DESCRIPTION OF THE INVENTION

Figure 2:
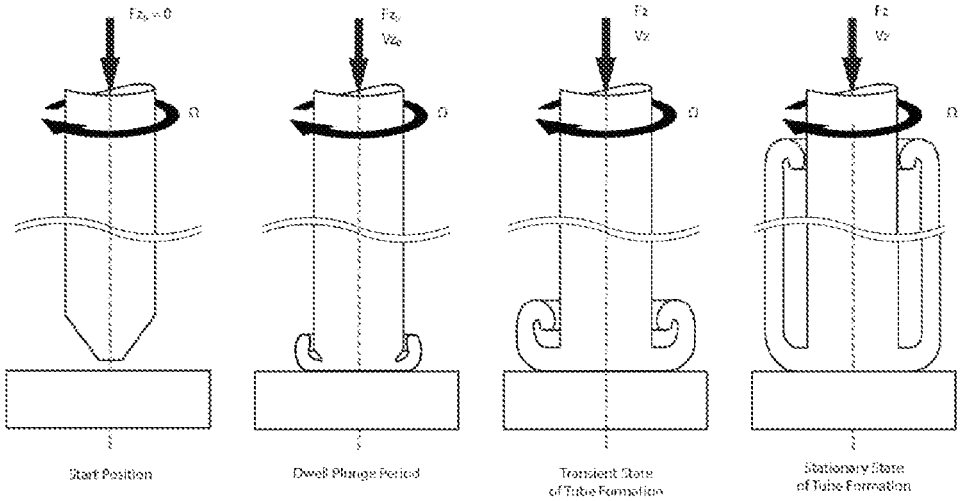
Figure 3:
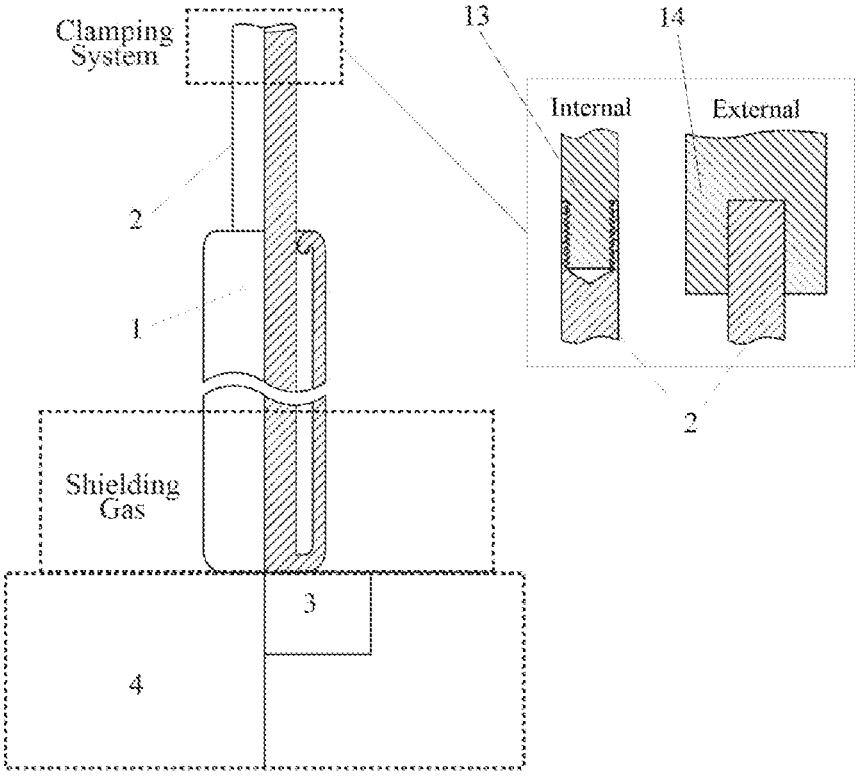
Figure 4:
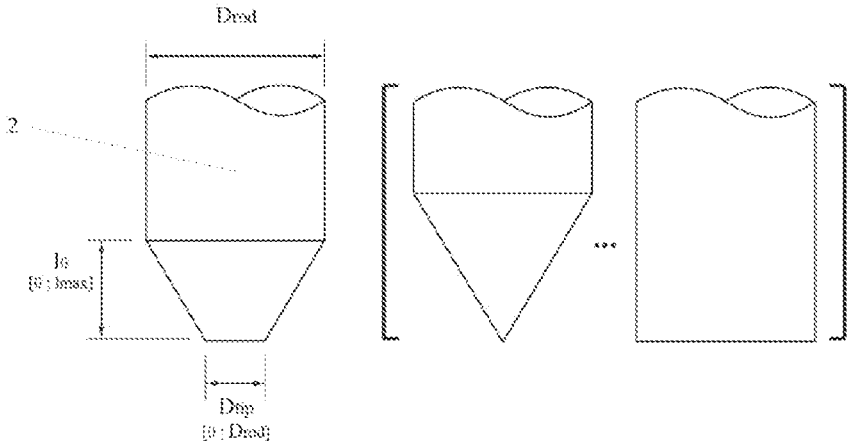
Figure 5:
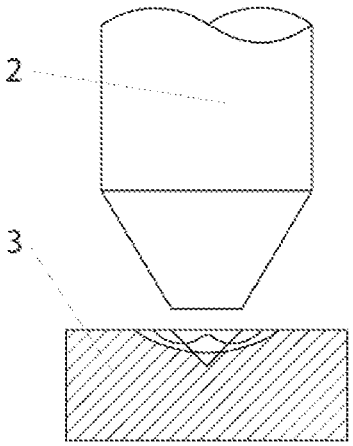
Figure 6:
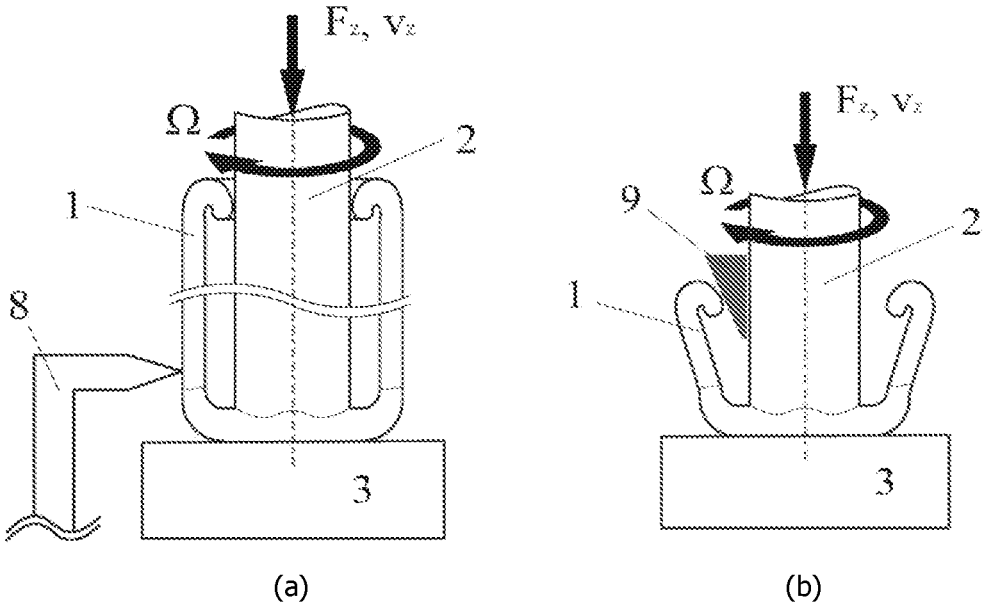
Figure 7:
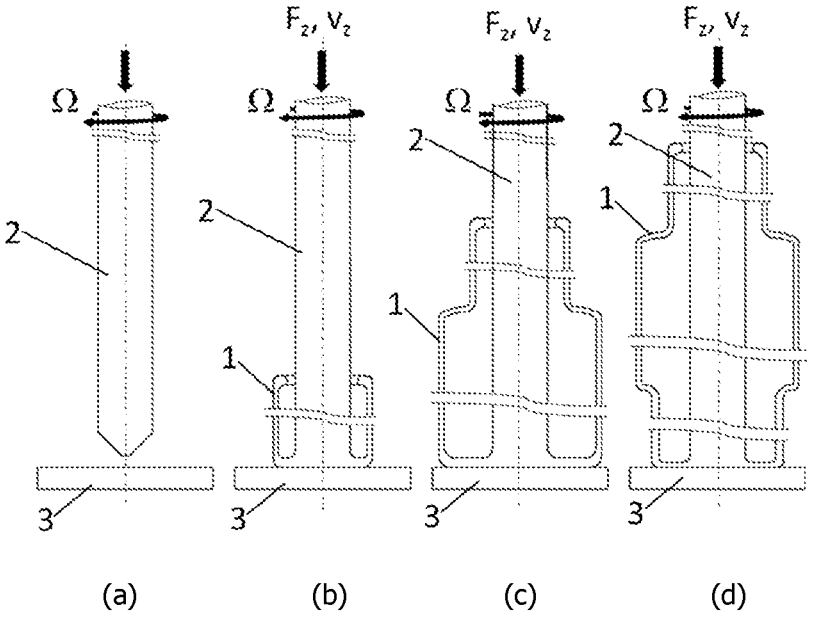
Figure 8:
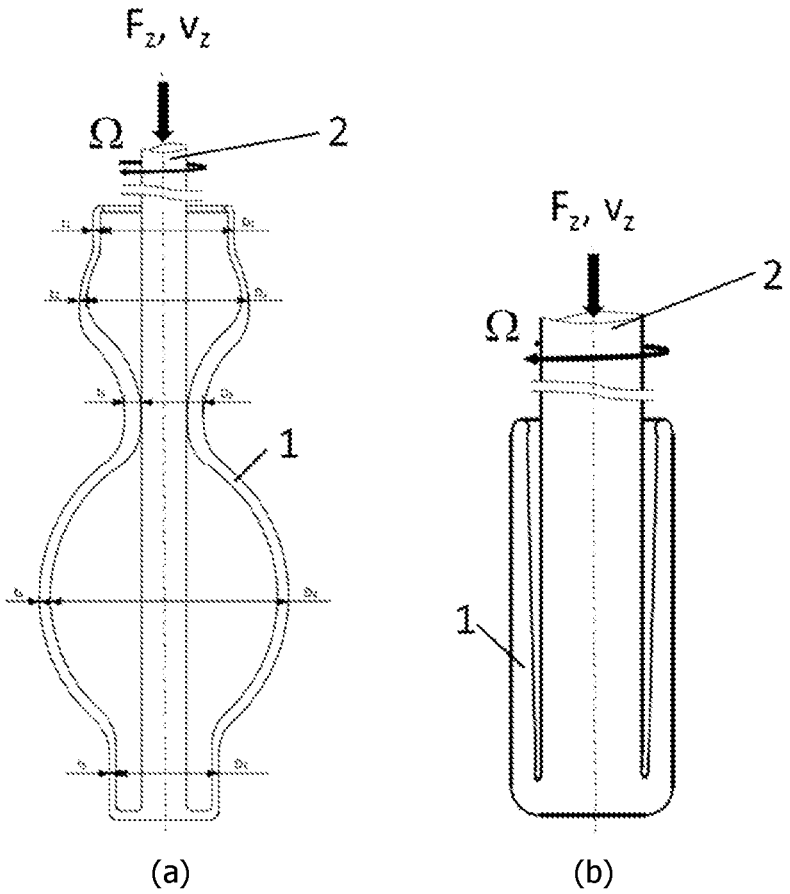
Figure 9:
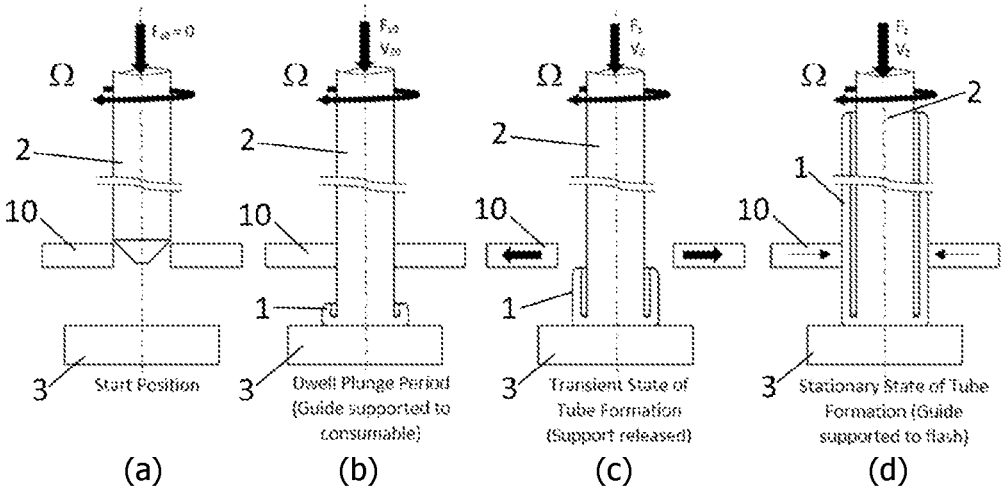
Figure 10:
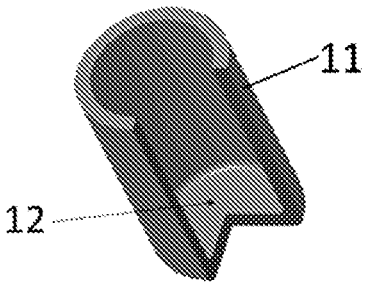

The present invention is in the following described in more detail in the form of examples of preferred embodiments by referring to the attached drawings, wherein FIG. 1 is a schematic drawing of two alternative embodiments of the present invention, FIG. 2 is a schematic drawing of the sequence of the main plunge periods in one embodiment of the present invention, FIG. 3 is a schematic representation of alternative clamping of the consumable rod in the present invention, FIG. 4 is a schematic representation of the range of possible geometries for the tip of the consumable rod 2 at the start position such as that one presented in FIG. 2, FIG. 5 is a schematic representation of alternative shapes, for the contacting surface with the rod 2, of the non-consumable insert according to the invention, FIG. 6 is a schematic representation of a sample of possible boundary conditions (e.g. geometrical, mechanical and thermal conditions) applied to the flash, FIG. 7 shows the different tube formation periods for producing a tubular shape having three different main outer diameters in accordance with the present invention, FIG. 8 depicts two tailor made tubes with continuous varying outer diameter and/or thickness, FIG. 9 illustrates a particular embodiment for manufacturing long tubes according to the invention, but with additional use of support guides for the consumable rod and the tube under formation, and FIG. 10 is schematic illustration of a canister made according to the invention.

In FIG. 1 is presented the process fundaments during stationary state of plunge period (i.e. tube formation, cf. FIG. 2) of the present invention, with representation of the alternative control of the plunge force (Fz) or plunge speed (Vz). In alternative (a) the rod 2 rotates at a rotational speed Ω with plunge force Fz or plunge speed Vz against the anvil 3 that is stationary. In alternative (b) the rod 2 is stationary while the anvil 3 is rotating against the rod 2 at a rotational speed Ω with plunge force Fz or plunge speed Vz.

The method of the invention is a process to produce seamless tubes, extracted from the flash 1 continuously produced during the plunging of a consumable rod 2 against a non-consumable rigid anvil 3 as in alternative (a) in FIG. 1 or a non-consumable rigid anvil 3 is plunged against consumable rod 2 as in alternative (b) in FIG. 1. Between the rod 2 and the anvil 3 there is a relative rotational speed Ω. The flash 1 forms a net-tube that is cylindrical with stable and controllable geometry. The axis of symmetry of the flash 1 is coincident with the axis of the consumable rod 2 and the axis of rotation during the plunging period. The geometry of the flash 1 has an outer diameter and thickness that are set via controlling of the following parameters:

- Plunge parameters: plunge force Fz or plunge speed Vz;
- Relative rotational speed Ω between the consumable rod 2 and the non-consumable rigid anvil 3;
- Diameter of the consumable rod 2;
- Thermo-physical properties of the consumable rod 2 material;
- Boundary conditions (e.g. geometrical, mechanical and thermal conditions) applied to the flash 1.

The consumable rod 2 consists of a base material while the nonconsumable rigid anvil insert 3 is made of a material that has a mechanically rigid behaviour, with enough toughness, at the peak processing temperature, e.g. a refractory material. The anvil insert 3 may be mounted in a rigid backing plate 4 or anvil insert support (water cooled option). The consumable rod 2 may with respect of state of the base material be divided into three zones or domains: a cool domain 5 of the consumable rod wherein the base material of the rod is elastic; a pre-heat zone domain 6 of the consumable rod wherein the base material of the rod is elastic-plastic; and a hot solid-state domain 7 of the consumable rod wherein the base material of the rod is visco-plastic. This division into three zones or domains is the same in both alternatives (a) and (b) in FIG. 1.

The "Speed profile" indicated in FIG. 1 represents the intensity of the rotational speed as a profile for the different sub-zones of the consumable rod 2. A significant part of the heat is generated in the discontinuity of the speed profile between the pre-heat zone of consumable rod domain 6 and the hot solid-state consumable rod domain 7. In the "Stick-friction" condition indicated in FIG. 1 the hot solid-state consumable rod domain 7 sticks to the non-consumable rigid anvil insert 3, and thus the speed profile has zero value at this interface. In the "Sliding" friction condition also indicated in FIG. 1 the hot solid-state consumable rod domain 7 slides over the non-consumable rigid anvil insert 3, and thus the speed profile has a value higher than zero, at this interface.

FIG. 2 depicts the sequence of the main periods of the method of invention for tube formation: (a) Start position; (b) Dwell plunge period; (c) Transient plunge period; (d) Stationary plunge period.

At the start position (a) the consumable rod 2 rotates with a rotational speed Ω but it is not yet in contact with the anvil 3 and the plunge force $Fz_0$ of the rod 2 is 0 (zero). At this point there is thus no flash formation yet.

During the dwell plunge period (b) the consumable rod 2 is plunged against the rigid anvil 3 rotating at a rotational speed Ω with an initial plunge force $Fz_0$ and initial plunge speed $Vz_0$ of the rod 2. In this period the flash 1 is starting to form but it is not yet fully developed for the formation of e.g. tubes.

At the end of the initial transient plunge period (c) the consumable rod 2 is plunged against the rigid anvil 3 rotating at a rotational speed Ω with an plunge force Fz and plunge speed Vz of the rod 2, wherein $Fz>Fz_0$ and $Vz>Vz_0$. During this period the flash 1 has had time to fully develop its geometry towards the desired geometry.

During the stationary plunge period (d) the consumable rod 2 is plunged against the rigid anvil 3 still rotating at a rotational speed Ω with the same plunge force Fz and plunge speed Vz of the rod 2 as during the transient plunge period (d), but now the flash 1 has had time to fully develop the desired geometry for the formation of tubes or other tubular shapes.

The dimensions of the flash are possible to keep constant or to be modified during the processing method of the invention. A continuous modification of outer diameter and/or thickness of the flash is possible through control of the process parameters, e.g. boundary conditions, within the domain of stable operative window of parameters.

FIG. 3 depicts that for being able to plunge the consumable rod 2 against the anvil 3 (or the other way around) with a relative rotational speed Ω, a plunge force Fz and a plunge speed Vz, the rod 2 needs to be clamped in some way to a device that rotates and plunges the rod 2 against the rigid anvil 3 that needs to be held in place by a rigid backing plate 4 or the like. In the magnified window of the upper end part of the consumable rod 2 is shown two alternatives for clamping; internal clamping 13 and external clamping 14 of the rod 2.

The internal clamping 13 solution of the rod 2 represented in FIG. 3 enables a quasi-complete plunging of the consumable rod 2, i.e. a plunging to the level of the hot solid-state consumable rod domain 7, transforming most of the initial consumable rod 2 into a tubular shape from flash 1, such as a tube or a canister 11 (cf. FIG. 10).

FIG. 3 also shows a zone of "shielding gas" surrounding and shielding at least a part of the flash in that end of the rod that is transformed into flash. The "shielding gas" represents a volume containing the processed zone where a non-chemically reactive gas replaces the atmospheric gas and shields the processed zone while this zone is at temperatures higher than the room temperature.

FIG. 4 depicts a range of possible geometries for the tip of the consumable rod 2 at the start position. In all geometries shown in FIG. 4 the rod consists of a cylindrical part with the diameter $D_{rod}$ and a tip part having the diameter $D_{tip}$ in the range of $[0, D_{rod}]$. The shape of the tip may thus be in the form of a cone ($D_{tip}=0$), a truncated cone ($D_{tip}=]0, D_{rod}[$) or a cylinder ($D_{tip}=D_{rod}$). The tip part has a length $l_0=[0, l_{max}]$.

FIG. 5 shows three alternative shapes for the non-consumable anvil insert 3 namely a cone; a semi-spherical concavity, and a wavelike concavity. The respective functions of these alternative shapes are to provide a stable and preferential direction for the viscoplastic material flow of consumable rod 2, enabling the flash 1 to reach the desired final diameter. The anvil is made of a material that has a mechanically rigid behaviour, with enough toughness, at the peak processing temperature, e.g. a refractory material.

In FIG. 6 is presented two embodiments, (a) on the left and (b) on the right, of a sample of possible boundary conditions, e.g. geometrical, mechanical and thermal conditions, applied to the flash.

In embodiment (a) of FIG. 6 is depicted a method for outer surface finishing and dimensional control of the flash 1 that is formed during the method of invention. Embodiment (a) involves the use of one or more cutting tool devices 8 that may be stopped or moving (axially or radially in relation to the axis of the consumable rod 2) for finishing the rotating flash 1 into a tubular shape with desired outer diameters, thicknesses and/or lengths. The cutting tool device 8 may be used for cutting either during the formation of the flash 1, i.e. during the plunging phases (transient or stationary), or after the plunging is completed and the flash 1 is still rotating.

In embodiment (b) of FIG. 6 is illustrated a method for producing variable tube dimensions along the length of the tube formed from the flash 1. The variable tube dimension along the length of the tube to be formed is achieved by using one or more mould devices 9 to shape the tubular shape (also called net-tube formation) formed from the flash 1. The mould device 9 illustrated in the embodiment (b) of FIG. 6 has the shape of a truncated cone with a central cylindrical through-bore having the same inner diameter as the outer diameter of consumable rod 2. The central lengthwise axis of the cylindrical through-bore is coincident with the central lengthwise axis of the mould device 9. The mould device 9 is inserted around the consumable rod 2 before starting the tube formation. The flash 1 formed this way will have precise outer and inner dimensions. The consumable rod 2 surrounded by the mould device 9 is plunged against the anvil 3 at a rotational speed Q with a plunge force Fz and plunge speed Vz. During the movement of the rod 2 against the anvil 3, the mould device 9 is kept at the same distance from the anvil 3.

In FIG. 7 is depicted, from left to right, (a) the start position, (b) the stationary plunge period with a first stable dimension of the flash 1, (c) the stationary plunge state of tube formation, with different parameters from the previous one (b) resulting in a different but stable flash 1 dimension, and (d) the stationary plunge state of tube formation with different parameters from the previous periods (b) and (c), resulting in a situation where a rotative consumable rod 2 is plunged against a non-rotative 3 non-consumable rigid anvil 3 to form a tube having three different main outer diameters. The shape of the tube or canister is formed from the continuous flash 1 resulting from the continuous plunging process is achieved in an open die condition, i.e. without any closed dies, only by varying the plunging parameters, plunging force $F_z$, plunging speed $V_z$, and rotational speed Ω during the plunging phase.

The capacities for tailor made tubes in a wide range of dimensions, include the possibility to innovate tube design based on continuously varying section configurations, similarly to the capacity of shaping a pot from a piece of clay. FIG. 8 shows an example of this kind of tube formation when a consumable rod 2 is plunged against a rigid anvil 3. In the right-hand side tube formation example (b) is depicted a stationary state of a flash 1 with constant outer diameter and continuous varying thickness. In the left-hand side flash 1 formation example (a) is depicted a stationary state of a flash 1 formed from processing parameters plunging force F plunging speed V and rotational speed Ω being continuously varied over time, resulting in different outer diameters and thicknesses of the tube in its longitudinal direction, Among each possible outer diameters (D) and thicknesses (t) of the tube the following are depicted in the figure as examples: thicknesses $t_1$, $t_2$, $t_3$, $t_4$, $t_5$ and corresponding diameters $D_1$, $D_2$, $D_3$, $D_4$, $D_5$.

In FIG. 9 is depicted an embodiment particularly meant for producing long cylindrical tubes where both the consumable rod 2 and the flash 1 are supported to prevent any loss of stability of the rotating axis of the consumable rod 2 (e.g. via buckling) at a certain phase of a plunging process, having the steps, from left to right, (a) the start position, (b) the dwell plunge period, (c) the transient state of tube formation, and (d) the stationary state of tube formation. In this particular embodiment a rotative consumable rod 2 is plunged against a non-rotative non-consumable rigid anvil 3 to form a tube from a flash continuously produced at the working zone in an open die condition (i.e. no die is used for shaping the tube from the flash).

In order to prevent buckling of the consumable rod 2 a guiding ring 10 with gliding contact with the rod 2 is used. In the start position (a) of the plunging process the tip, shaped as a truncated cone, of the consumable rod 2 is inside the guiding ring 10 but the rod is not yet in gliding contact with the guiding ring 10. At this start position (a) the consumable rod 2 has a rotational speed Ω and a plunging force $F_{z0}$=0. In the dwell plunge period (b) the consumable rod 2 has moved through the guiding ring 10 in gliding contact therewith and supported thereby. In this period the consumable rod 2 has a rotational speed of is Ω, a plunging force $F_{z0}$, a plunging speed $V_{z0}$ and the flash formation, and the tube formation therefrom is yet in its initial state. When the plunging process reaches the transient state (c) of tube formation, the support, that is, the guiding ring 10 is released by pulling apart, in opposite directions, the two or more components that the guiding ring 10 is comprised of, before the flash 1 (tubular shape under formation) reaches guiding ring 10. The structure behind the mechanism allowing the pulling apart is not shown in the figure. In the transient state (c) of the tube formation the consumable rod 2 has a rotational speed of Ω, a plunging force $F_z$, a plunging speed $V_z$. In the stationary state (d) of the tube forming two or more components of another guiding ring 10 is closed around a section of the flash 1 being formed in order to support and stabilize said flash 1 (i.e. not to shape the flash) along its circumference. In this state the consumable rod 2 has a rotational speed of is Ω, a plunging force $F_z$, a plunging speed $V_z$.

Long tubes can be obtained from several engineering design solutions, namely:

- Continuous feeding of a non-rotative rod 2 using a rotative non-consumable rigid anvil 3;
- Using long rods with support guides 10, applied initially to the rod, and passing progressively to the flash 1. This prevents buckling of the consumable rod during the dwell, transient and stationary plunging periods;
- Using clamping systems with smaller or equal diameter to the rod diameter, to enable the plunging of the full length of the consumable rod, as represented in FIG. 3.

The method of the invention solves the following customer demands:

i) small series of ii) tailored made tubes in a iii) wide range of dimensions and iv materials.

Considering that the physical fundamentals (solid-state viscoplastic material flow) supporting the method of the invention enables to process thermomechanically almost all the engineering materials, this invention is able to solve the perceived market need for tubes made of materials not yet available in the market, besides the production of tubes made of materials already available in the market. The engineering materials suitable for a consumable rod used in the method and the tools of the invention include metals and alloys thereof. These metals may be ferrous or non-ferrous. Examples of ferrous metals include Cast Iron, Wrought Iron, Stainless steels and Steels, such as, Structural Mild Steel, High Strength Steel, Silicon Steel, Tool Steel, Spring Steel, but are not limited thereto. Examples of non-ferrous metals are Aluminium, Nickel and Titanium, and alloys thereof, but the non-ferrous metals are not limited thereto.

Tubes and pipes are hollow shaped components with circular cross section and are one of the most common and thus significant components used in engineering solutions. The difference between tubes and pipes is the envisioned application, where pipes are used for fluid flowing and thus internal diameter is the most important dimension in design, and tubes are supposed to be used for remaining applications, with external diameter and wall thickness as the most important dimensions.

Applications of tubes are found in structural and non-structural applications, in a wide range of quality and precision specifications. Examples of relevant fields of application are structural space frames, oil and gas distribution, heat exchangers, boilers, and, air conditioning and domestic water distribution. Emphasis also to the increasing number of applications in precision mechanics namely via capillary tubes for medical applications, measurement devices and control systems. The chemical industry field, e.g. cosmetics & oral care, food & beverages and pharmaceuticals, is one other intensive user of tubes.

In particular, the metallic tubular components are broadly categorized, according to the manufacturing method as: i) seamless tubes; and ii) welded tubes.

The welded tubes are optionally welded in line with continuous forming for thinner sheets or welded after bending and forming for thicker plates. Welded tubes have asymmetric properties, including a fusion zone with local modification of original dimension features, and a heat affected zone with sub-zones of toughness and hardness mismatching the ones from the base material. In fact, this general classification of tubular structures encloses and emphasizes how to distinguish the applications of seamless tubes from welded tubes.

The seamless tubes have outstanding homogeneity in the circumferential direction and thus better mechanical resistance and more reliable structural and dimensional properties. Seamless tubes are the favourites for application involving extreme loading conditions, such as, static and cyclic internal pressure (e.g. tube hydroforming), torsion and impact under a wide range of service temperatures (e.g. drilling and pumping petroleum and natural gas). Seamless tubes are also the choice for applications demanding high quality and geometric precision and stability, from macro to micro-applications.

In FIG. 10 is depicted a canister 11 that has been made by the method of invention, e.g. by plunging a rotative consumable rod against a non-rotative rigid anvil. A canister is achieved by the method of the invention simply by not cutting away the bottom of the flash 1 that is formed in the contact zone between a consumable rod 2 and a rigid anvil 3.

Example of Application Sample Conditions, Parameters and Results

- Consumable rod material: cold roiled structural steel of grade S355; diameter [mm]=15
- Spindle: Consumable rod rotation [Ω, rpm]=2888; Tool rotation direction=CW
- Transient plunging period: Control Method=Speed control; Plunging Speed [cm/min] (consumable rod)=0.15; Initial Plunge depth [mm]=3.9
- Stationary plunging period: Control Method=Force control; Fz [kN]=26.60
- Non-consumable rigid anvil insert 3, mounted in a support with water cooling in closed circuit, with inlet temperature of about 10° C.

The tubular (cylindrical) product formed from the flash obtained in the plunging process had an outer diameter of 27 mm and a thickness of 2.8 mm.

The invention claimed is:

1. A method for manufacturing a seamless tubular shape formed by continuously-produced flash, comprising the step of plunging a consumable rod against a rigid anvil, wherein the consumable rod has a longitudinal axis and there is a relative rotational speed between the consumable rod and the anvil about an axis of rotation that is coincident with the axis of the consumable rod, and where said continuously-produced flash is obtained by viscoplastic deformation of the consumable rod against the rigid anvil in full open die condition, and where the rigid anvil is a plate unit with no through holes in the zone in contact with the consumable rod.

2. A method according to claim 1, where the consumable rod has a longitudinal axis and there is a relative rotational speed (Vz) between the consumable rod and the anvil about an axis of rotation that is coincident with the axis of the consumable rod.

3. A method according to claim 1, where the consumable rod has a longitudinal axis coincident with an axis of symmetry of the flash.

4. A method according to claim 1 where the consumable rod is cylindrical with a diameter along a longitudinal axis thereof.

5. A method according to claim 4 where the consumable rod is cylindrical with a constant-diameter along the longitudinal axis thereof.

6. A method according to claim 4 where the consumable rod is cylindrical with a variable-diameter along the longitudinal axis thereof.

7. A method according to claim 1 where plunging of the rotating consumable rod or anvil is performed using an alternative selected one of a force control mode and a speed control mode, and where it is possible to change the selected one during plunging.

8. A method according to claim 1 where the outer diameter and thickness of the flash is set by controlling of at least one of the following parameters:

- plunge force or plunge speed;
- relative rotational speed between the consumable rod and the rigid anvil;
- diameter of the consumable rod;
- thermo-physical properties of the consumable rod material;
- thermo-physical properties of the optionally consumable anvil material;
- boundary conditions (e.g. geometrical, mechanical and thermal conditions) applied to the flash.

9. A method according to claim 1 including the following steps:

- starting the relative rotation between the consumable rod and the rigid anvil;
- bringing the consumable rod into contact with rigid anvil under speed control;
- starting the plunging period under an alternative one of force control and speed control;
- adjusting the relative rotation, control mode and its value towards the final desired tubular shape;

and thereafter selectively obtaining a tube or a cannister, where

- obtaining a tube comprises extracting both an open end and a closed end from the tubular shape remaining at the completion of the plunging phase; and
- obtaining a canister comprises extracting only the open end from the tubular shape remaining at the completion of the plunging phase.

10. A method according to claim 1 where the consumable rod and flash independently of each other are free or guided, to prevent loss of stability, during the plunging phase.

11. A method according to claim 1 where the consumable rod is plunged with the support of a rigid non-consumable rod, clamped to the consumable rod, and used as a plunger of the consumable rod, during the plunging phase.

12. A method according to claim 1 where the rigid anvil is a non-consumable plate unit.

13. A method according to claim 1 where the rigid anvil is a consumable plate unit.

* * * * *